US008187342B2

(12) United States Patent
Oswal et al.

(10) Patent No.: US 8,187,342 B2
(45) Date of Patent: May 29, 2012

(54) PROCESS FOR INDIGO DYEING OF WOOL AND WOOL BLENDS

(75) Inventors: Jangi Lal Oswal, Punjab (IN); Rishi Oswal, Punjab (IN)

(73) Assignee: Malwa Industries Limited, Punjab (IN)

( * ) Notice: Subject to any disclaimer, the term of this patent is extended or adjusted under 35 U.S.C. 154(b) by 938 days.

(21) Appl. No.: 10/572,436

(22) PCT Filed: Sep. 18, 2003

(86) PCT No.: PCT/IN03/00318

§ 371 (c)(1),
(2), (4) Date: Jan. 3, 2007

(87) PCT Pub. No.: WO2005/026435

PCT Pub. Date: Mar. 24, 2005

(65) Prior Publication Data

US 2007/0107144 A1 May 17, 2007

(51) Int. Cl.
*C09B 7/00* (2006.01)

(52) U.S. Cl. ..... 8/653; 8/478; 8/917; 442/152

(58) Field of Classification Search ..... 8/653, 636
See application file for complete search history.

(56) References Cited

U.S. PATENT DOCUMENTS

| | | | | |
|---|---|---|---|---|
| 2,254,965 | A | | 9/1941 | Kling et al. |
| 2,367,273 | A | | 1/1945 | Hall et al. |
| 2,450,773 | A | | 10/1948 | Weber |
| 3,457,022 | A | | 7/1969 | Fields |
| T100201 | I4 | | 1/1981 | Logullo |
| 4,615,709 | A | | 10/1986 | Nakao |
| 5,361,438 | A | | 11/1994 | Parati |
| 5,611,822 | A | * | 3/1997 | Gurley ..... 8/625 |
| 7,097,909 | B2 | | 8/2006 | Jansen et al. |
| 7,235,110 | B2 | | 6/2007 | Alpert |

FOREIGN PATENT DOCUMENTS

| | | | |
|---|---|---|---|
| GB | 372325 | | 4/1932 |
| GB | 448272 | | 6/1936 |
| GB | 948890 | | 2/1964 |
| GB | 1006893 | * | 4/1964 |
| GB | 1006893 | A | 10/1965 |
| GB | 1488722 | A | 10/1997 |
| JP | 4-281079 | A | 10/1992 |
| JP | 2004-36037 | A | 2/2004 |
| JP | 2004210887 | A | 7/2004 |
| KR | 1020040043873 | A | 5/2004 |

OTHER PUBLICATIONS

Chaudhary et al.; "Synthesis and Properties of Cationized Wool"; AATCC Review; Jan. 2003; pp. 27-29, North Carolina State University, Raleigh, North Carolina, United States.

* cited by examiner

*Primary Examiner* — Harold Pyon
*Assistant Examiner* — Katie L Hammer
(74) *Attorney, Agent, or Firm* — The Webb Law Firm

(57) ABSTRACT

A process for indigo dyeing of wool and wool blends comprising the steps of subjecting the wool and wool blends to a step of pretreatment by impregnation with a shrink resistance agent, subjecting the pretreated wool and wool blend yarns to the step of indigo dyeing and post dyeing, wherein the step of dyeing and post dyeing includes a single step or a plurality of steps of impregnation of the pretreated wool and wool blends in an indigo dye bath followed each time by the step of oxidation.

9 Claims, No Drawings

PROCESS FOR INDIGO DYEING OF WOOL AND WOOL BLENDS

FIELD OF INVENTION

This invention relates to a process for indigo dyeing of wool and wool blends.

BACKGROUND OF INVENTION

It is generally known that indigo is a vat dye which is insoluble in water. However, when the vat dye is reduced to the leuco form by addition of sodium hydrosulphide and sodium hydroxide, it is dissolved into a reduced form, but without any colour. Thus, to impart a colour, the leuco soluble form is subjected to the step of oxidation.

The process of dyeing with indigo is essentially known with respect to cotton yarn. Such a process of dyeing is carried out with the cotton yarn being in X open width or rope form. In the open width form total no. of ends required are arranged in a spread condition and are dyed and sized in one go to get a weaver's beam.

In the rope dyeing form, the yarns we formed into a rope. Generally, a single rope consists of approximately 350 to 400 yarns and passed through dyeing vats. After dyeing, the rope is opened to cause a separation of the yarns on reels and to provide the yarns in a side by side relationship to get a spread sheet.

U.S. Pat. No. 5,361,438 discloses a method of indigo dyeing so as to allow the yarns to be used in knitting machines. Specifically, U.S. Pat. No. 5,361,438 suggests a method to dye the yarn in skeins or hanks so that the dyed yarn can be wound on a spool rather than on a reel. In such a process, the yarn is in the skein form and placed on a feed and drawn roller and such that the skein is passed through a plurality of indigo dye baths followed by oxidation. The number of dye baths each followed by oxidation depends on the colour intensity.

U.S. Pat. No. T 100, 201 discloses a method for indigo dyeing of polyester fibers. In such a process the fibres are first coated with a polymeric salt so as to provide washdown and fading properties similar to indigo dyed cotton fibers.

Reverting to the continuous process of indigo dyeing of cotton yarn, the process consists in forming the yarns into ropes, each rope consisting of a bundle of yarns. Such ropes are introduced into a vat dye bath containing the indigo dye followed by oxidation. A plurality of vat dye baths may be provided and followed each time by the step of oxidation, the number of such repetitive steps of impregnation and oxidation being dependent on the intensity of colour to be dyed on the yarn.

The process of indigo dyeing on wool yarn by a batch process could perhaps be carried out by impregnating wool yarn in a spread form in a vat dye bath. The impregnated yarns are then hung in a loose form and subjected to the step of oxidation. Appropriate batch process for the indigo dyeing of woolen yarn has not been described in any literature, though a manner in which such a process could perhaps be carried out has been described hereinabove.

SUMMARY OF THE INVENTION

An object of this invention is to propose an indigo dyeing of wool and wool blends.

Another object of this invention is to propose an indigo dyeing of wool and wool blends using the same dyeing apparatus as known with respect to cotton yarn.

Still another object of this invention is to propose an indigo dyeing of wool and wool blends having suitable dyeability factor.

Yet another object of this invention is to propose an indigo dyeing of wool and wool blends, which has dimensional stability.

A further object of this invention is to propose an indigo dyeing of wool and wool blends employing the known dyeing unit but using different parameters.

DETAILED DESCRIPTION OF INVENTION

According to this invention there is provided a process for indigo dyeing of wool and wool blends comprising the steps of subjecting the wool and wool blends to a step of pretreatment prior to the spinning of the yarn by impregnation with a shrink resistance agent, subjecting the pretreated wool and wool blend to the step of indigo dyeing, post dyeing and said step of dyeing and post dyeing including a single step or a plurality of steps of impregnation of the pretreated wool and wool blends in a vat dye bath followed each time by the step of oxidation.

The term wool used herein is intended to imply wool in loose tops, hanks, yarn packages etc. (e.g. Cones, Cheeses, Beams etc.) yarn ropes/sheets and fabrics. Further the present invention may be used as a continuous or batch, through distinct advantages are associated with a continuous process. Still further, the parameters described herein are with respect to a continuous process which are not intended to be implied in a restrictive manner with respect to a batch or continuous process.

One of the aspects of this invention resides in subjecting woolen and woolen blends to a shrink resist treatment prior to the step of dyeing. The shrink resist treatment may be effected in the spun yarn itself. However, the homogeneity is reduced on a spun yarn in comparison to effecting the shrink resist treatment to the fibre or wool top. The yarn is in a twisted form, and therefore the homogeneity is considerably reduced if such a shrink resist treatment is effected on the yarn. However, in effecting such a treatment prior to the step of spinning, the separated fibres are disposed along the longitudinal axis and spaced from each other, and whereby the absorbality is improved in comparison to a yarn. Such an absorbality provides a better dye uptake.

The shrink treatment composition and operating temperatures and time period are described hereinabelow. However, such operating temperatures and time period are only exemplary in nature and in no instance to be construed in a restrictive manner.

Treatment Procedure:

Set the bath at 15° C. with a composition of

| | |
|---|---|
| Acetic acid | 0.3-0.5 gpl |
| Sodium Sulphate | 1.5-3.0 gpl |
| Basolan DC (Sodium dichloro iso cynuric Dehydrate, Shrink Resist Chemical) | 3.0-5.0 gpl |
| pH | 3.5 to 4.0 gpl |

The temperature is raised to 50° C. at 1° C. per minute maintaining a pH of 3.50 to 4.0 and held 60 minutes.

Then sodium metabisulphite of 1.5-3.0 gpl is added. The bath is run for 35 minutes and drained. The tops are then washed twice cold, once hot (60° C.) and finally cold.

The flow chart of the process for the present invention is shown hereinbelow with respect to wool being in the form of a rope and the process is continuous in nature. However, the flow chart does not show the pretreatment steps and the shrink resist treatment steps. The flow chart essentially shows certain of the operating parameters of the known machine for a continuous process, but having operating parameters for dyeing of wool in rope form. It is considered that the impregnation period and that of oxidation is inversely proportionate to the speed of the machine.

FLOW CHART

100% WOOL

↓

BALL-WARPING
LONG FORMING (M/c. Speed 75-100 mpm)
Creel Tension 25-30 gms)

↓

ROPE-DYEING
INDIGO DYEING

↓

REBEAMING (ON LCB M/C) (M/s. Speed 75-100 mpm)
Rope Tension 5-10 psi)

↓

SIZING

↓

WEAVING

↓

FABRIC SETTING

↓

FINISHING

A typical dye bath is as follows:

| | |
|---|---|
| Caustic soda - | 1.5 to 3.0 gpl |
| Sodium hydrosulphite | 1.8 to 3.0 gpl |
| Indigo - | 0.5-5.0 gpl |
| An ionic Wetting agent (Primasol NF-Salt of phosphoric acid ester) | 0.05 to 0.5 gpl |
| An ionic Dispersing Agent (Setamol WS-Condensation product of an aromatic sulphonic acid) | 0.05 to 0.5 gpl |
| Dye - bath temperature | 25° C.-35° C. |
| pH | 11.2-12.5 |

The flow chart for the slasher process for the dyeing of wool is as follows, but without showing the shrink resist treatment and ten pretreatment.

SLASHER DYEING PROCESS FLOW

100% Wool Yarn

↓

Direct Warping

↓

Indigo Dyeing cum sizing

↓

Weaving

↓

Finishing

A typical dye bath for the slasher process is

| | |
|---|---|
| Caustic soda - | 1.5 to 3.0 gpl |
| Sodium hydrosulphite | 1.8 to 3.0 gpl |
| Indigo - | 0.5-5.0 gpl |
| An ionic Wetting agent (Primasol NF-Salt of phosphoric acid ester) | 0.05 to 0.5 gpl |
| An ionic Dispersing Agent (Setamol WS-Condensation product of an aromatic sulphonic acid) | 0.05 to 0.5 gpl |
| Dye - bath temperature | 25° C.-35° C. |
| pH | 11.2-12.5 |

The flow chart for hank indigo dyeing of woolen material is as follows.

Top Indigo Dyeing and Hank Indigo Dyeing of Woolen Material:

SR Treatment of Woolen Tops

↓

Dyeing of Tops in Batch Reduced Form

↓

Oxidation

↓

Washing

↓

Drying

A typical dye bath is as follows:

| | |
|---|---|
| Caustic soda - | 1.5 to 3.0 gpl |
| Sodium hydrosulphite - | 1.8 to 3.0 gpl |
| Indigo - | 0.5-5.0 gpl |
| An ionic Wetting agent (Primasol NF-Salt of phosphoric acid ester) | 0.05 to 0.5 gpl |

-continued

| | |
|---|---|
| An ionic Dispersing Agent (Setamol WS-Condensation product of an aromatic sulphonic acid) | 0.05 to 0.5 gpl |
| Dye - bath temperature | 25° C.-35° C. |
| pH | 11.2-12.5 |

Reference is made hereinafter to process parameters for indigo dyeing of wool in the form of rope. However, the flow chart and the parameters are only illustrative. Further, the resist shrink treatment is not shown.

Critical Process Parameters with Dyeing Recipe for Rope Dyeing of Woolen Yarn:

Critical process parameters for Indigo Dyeing of woolen yarn on Rope Dyeing

| PROCESS FLOW CHART | | | |
|---|---|---|---|
| CREEL SECTION M/C SPEED-23 MPM (Speed Range 16 mpm-28 mpm) | | | |
| ↓ | | | |
| WASH BOX-1 | (SCOURING: 02 GPL, PRIMASOL NF (WETTING AGENT), 80° C.) | | |
| ↓ | | | |
| WASH BOX-1 | (HOT WASH) 50° C. | | |
| ↓ | | | |
| WASH BOX-3 | (COLD WASH, ROOM TEMR.) | | |
| ↓ | | | |
| | | For 16 mpm | For 28 mpm |
| DYE BOX-1 (INDIGO DYEING) | DIPPING TIME - 23.5 SEC. | 33.78 SEC. | 19.3 SEC. |
| AIR OXIDATION | OXIDN. TIME - 102 SEC. | 146.6 SEC | 83.78 SEC. |
| ↓ | | | |
| DYE BOX-2 (INDIGO DYEING) | DIPPING TIME - 23.5 SEC. | 33.78 SEC. | 19.3 SEC. |
| AIR OXIDATION | OXIDN. TIME - 102 SEC. | 146.6 SEC. | 83.78 SEC. |
| ↓ | | | |
| DYE BOX-3 (INDIGO DYEING) | DIPPING TIME - 23.5 SEC. | 33.78 SEC. | 19.3 SEC. |
| AIR OXIDATION | OXIDN. TIME - 102 SEC. | 146.6 SEC. | 83.78 SEC. |
| ↓ | | | |
| DYE BOX-4 (INDIGO DYEING) | DIPPING TIME-23.5 SEC. | 33.78 SEC. | 19.3 SEC. |
| AIR OXIDATION | OXIDN. TIME-102 SEC. | 146.6 SEC. | 83.78 SEC. |
| ↓ | | | |
| DYE BOX-5 (INDIGO DYEING) | DIPPING TIME-23.5 SEC. | 33.78 SEC. | 19.3 SEC. |
| AIR OXIDATION | OXIDN. TIME-102 SEC. | 146.6 SEC. | 83.78 SEC. |
| ↓ | | | |
| DYE BOX-6 (INDIGO DYEING) | DIPPING TIME -23.5 SEC. | 33.78 SEC. | 19.3 SEC. |
| AIR OXIDATION | OXIDN. TIME-102 SEC. | 146.6 SEC. | 83.78 SEC. |
| ↓ | | | |
| DYE BOX-7 (INDIGO DYEING) | DIPPING TIME-23.5 SEC. | 33.78 SEC. | 19.3 SEC. |
| AIR OXIDATION | OXIDN. TIME-102 SEC. | 146.6 SEC. | 83.78 SEC. |
| ↓ | | | |
| DYE BOX-8 (INDIGO DYEING) | DIPPING TIME-23.5 SEC. | 33.78 SEC. | 19.3 SEC. |
| AIR OXIDATION | OXIDN. TIME-102 SEC. | 146.6 SEC. | 83.78 SEC. |
| ↓ | | | |
| WASH BOX-4 | (HOT WASH) 50° C. | | |
| ↓ | | | |
| WASH BOX-5 | (HOT WASH) 50° C. | | |
| ↓ | | | |
| WASH BOX-6 | (ACETIC ACID 10 GPL, WASH 60° C., $P^H$ 5-6) | | |
| ↓ | | | |
| WASH BOX-7 | (ACETIC ACID 10 GPL, WASH 40° C., $P^H$ 5) | | |
| ↓ | | | |
| DRYING (STEAM HEATED CYLINDER, STEAM PRESSURE UPTO 4.5 BAR). | | | |

Reference is made hereinabove to the step of scouring. Though sodium hydroxide is the normal scouring agent for cotton, it has been found that sodium hydroxide cannot be used for wool, and that a preferable agent is a detergent and a wetting agent.

Further, subsequent to the step of dyeing the hot washed dyed wool is washed with acetic acid as it helps in reversing any elongation loss.

We claim:

1. A process for continuous dyeing of pretreated wool and wool blends with indigo to produce dimensionally stable wool and wool blends, comprising, in order, the steps of:

subjecting shrink-resistant, dimensionally-stable pretreated wool and wool blends to at least one step of wetting and pre-dye washing;

subjecting said pretreated wool and wool blends to at least one step of indigo dyeing, and oxidizing to form a dyed wool and wool blend; and subjecting the dyed wool and wool blend to at least one step of post-dye washing, wherein, the at least one step of post-dye washing includes at least one hot wash and/or acid wash;

wherein the steps of dyeing and oxidizing together are less than about 5 minutes in duration per each at least one step of dyeing and oxidizing to form a dyed wool and wool blend; and wherein the steps of pre-dye washing, dyeing and oxidizing and post-dye washing are continuous in a same machine.

2. The process as claimed in claim 1, wherein the step of oxidizing is carried out by exposure to air.

3. The process as claimed in claim 1, wherein the machine has a speed of 16 to 28 meters per minute.

4. The process as claimed in claim 1, wherein the impregnation period in each bath and oxidation period is the same for each stage.

5. The process as claimed in claim 1, wherein the pretreated wool and wool blends are first treated with a wetting agent prior to the steps of washing.

6. The process as claimed in claim 1, wherein the wool is selected from a group consisting of wool in loose form, tops, hanks, sheet, rope, packages, cones, cheeses and beams.

7. The process as claimed in claim 1, wherein the dyeing step is performed in a dye bath, comprising 1.5 to 3.0 grams per liter caustic soda, 1.8 to 3.0 grams per liter sodium hydrosulphite, 0.5-5.0 grams per liter indigo, 0.05 to 0.5 grams per liter of anionic wetting agent, and 0.05 to 0.5 grams per liter anionic dispersing agent and wherein the dye bath is 25° C.-35° C. in temperature and 11.2-12.5 pH.

8. The process as claimed in claim 7, wherein the ionic wetting agent is a derivative of phosphoric acid ester.

9. The process as claimed in claim 7, wherein the of anionic dispersing agent is a naphthalene sulfphuric acid derivative.

* * * * *

UNITED STATES PATENT AND TRADEMARK OFFICE

CERTIFICATE OF CORRECTION

PATENT NO. : 8,187,342 B2
APPLICATION NO. : 10/572436
DATED : May 29, 2012
INVENTOR(S) : Jangi Lal Oswal et al.

It is certified that error appears in the above-identified patent and that said Letters Patent is hereby corrected as shown below:

In the Claims

Column 8, Line 6, Claim 9, after "the" delete "of"

Column 8, Line 7, Claim 9, delete "sulfphuric" and insert -- sulphuric --

Signed and Sealed this
Ninth Day of July, 2013

Teresa Stanek Rea
*Acting Director of the United States Patent and Trademark Office*